US008523282B2

(12) United States Patent
Wu

(10) Patent No.: US 8,523,282 B2
(45) Date of Patent: Sep. 3, 2013

(54) FOLDABLE LEG SUPPORT

(76) Inventor: Yao-Chuan Wu, Chiayi Hsien (TW)

( * ) Notice: Subject to any disclaimer, the term of this patent is extended or adjusted under 35 U.S.C. 154(b) by 279 days.

(21) Appl. No.: 13/005,740

(22) Filed: Jan. 13, 2011

(65) Prior Publication Data

US 2012/0181838 A1 Jul. 19, 2012

(51) Int. Cl.
*A47C 7/50* (2006.01)

(52) U.S. Cl.
USPC ..... 297/423.3; 297/423.36

(58) Field of Classification Search
USPC ..... 297/423.26, 423.33, 423.35, 423.36
See application file for complete search history.

(56) References Cited

U.S. PATENT DOCUMENTS 491,172 A * 2/1893 Hart ..... 297/276
2,550,593 A * 4/1951 Perry ..... 297/118
3,856,352 A * 12/1974 Jacobi, Sr. ..... 297/423.15
4,819,987 A * 4/1989 Stringer ..... 297/423.35
5,352,020 A * 10/1994 Wade et al. ..... 297/423.26
5,447,359 A * 9/1995 Asbjornsen et al. ..... 297/423.35
6,076,893 A * 6/2000 Brotherston ..... 297/423.35
6,382,727 B1 * 5/2002 Pickard ..... 297/423.36
7,108,329 B1 * 9/2006 Clough ..... 297/423.19
2012/0032490 A1 * 2/2012 Nowak et al. ..... 297/423.3

* cited by examiner

*Primary Examiner* — Peter Brown
(74) *Attorney, Agent, or Firm* — Alan Kamrath; Kamrath IP Lawfirm, P.A.

(57) ABSTRACT

A foldable leg support contains two rotary arms and a supporting surface between the two rotary arms, and the two rotary arms are rotatably connected with a seat member. When in a rest position, the foldable leg support is pulled outward to expand the supporting surface. Hence, the legs are capable of being extended on the supporting surface comfortably to improve blood circulation, and the foldable leg support is suitable for any size of the legs. When the foldable leg support is not used, the supporting surface is put between the two rotary arms, and, then, the rotary arms and the supporting plane surface are folded under an office chair, saving storage space.

12 Claims, 6 Drawing Sheets

FOLDABLE LEG SUPPORT

FIELD OF THE INVENTION

The present invention relates to office furniture and, more particularly, to a foldable leg support.

2. Description of the Prior Art

People working at an office for a long time have poor blood circulation to impact their health. However, a novel and inventive foldable leg support is capable of supporting legs comfortably to improve blood circulation.

The present invention has arisen to mitigate and/or obviate the afore-described disadvantages.

SUMMARY OF THE INVENTION

The primary objective of the present invention is to provide a foldable leg support that obtains a positioning function as a supporting surface is stored, and that includes a limiting block defined on an inner side of a first end of a rotary arm to support the supporting surface when the foldable leg support is expanded and retracted.

A further objective of the present invention is to provide a foldable leg support which having the supporting surface including a handle arranged therebeneath to turn the supporting surface easily. When the rotary arm is expended and retracted, a boss of a rotating bar is inserted into two different locking elements, thereby positioning the rotary arm. When the rotating bar is rotated outward, the boss is disengaged from the locking element, thus rotating the rotary arm.

Another objective of the present invention is to provide a foldable leg support capable of comforting a user's leg.

To obtain the above objectives, a foldable leg support provided by the present invention contains two rotary arms and a supporting surface between the two rotary arms, with the two rotary arms being axially rotatably connected with a seat member. Two first ends of the two rotary arms are rotatably connected with two sides of the seat member respectively, and two second ends of the rotary arms are rotatably coupled with the supporting surface individually. The supporting surface includes two semi-periphery projections disposed on two peripheral sides thereof respectively, and each semi-periphery projection is biased against by a spring. Each rotary arm includes a notch fixed on an inner side thereof to retain with the semi-periphery projection or includes a hole fixed on an inner side thereof to retain with the semi-periphery projection.

Each rotary arm includes a limiting block defined on an inner side of the first end thereof.

The two first ends of the two rotary arms are rotatably coupled with the two sides of the seat member. The supporting surface is fixed or is slidably defined supported between the two rotary arms by using two guide rails formed on an inner sides of the two rotary arms.

The seat member includes positioning protrusions formed therebeneath, and a shaft is inserted through the positioning protrusions. The rotary arms are fitted on the shaft to connect with the positioning protrusions rotatably.

Between the rotary arm and the positioning protrusions is defined a rotating bar. Each and positioning protrusion includes two locking elements disposed therein, and each locking element is retained with a boss of the rotating bar.

The locking element is selected from a cutout, a bore, and a recess.

The supporting surface is made of a soft fabric material, a soft net-shaped material, or a feather material and is formed by selecting from a curved surface and a flat surface.

Thereby, when in a rest position, the foldable leg support is pulled outward to expand the supporting surface. Hence, the legs are capable of being extended on the supporting surface comfortably to improve blood circulation, and the foldable leg support is suitable for any size of the legs.

Besides, when the foldable leg support is not used, the supporting surface is put between the two rotary arms. Then, the rotary arms and the supporting surface are folded under an office chair, saving storage space.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1A:
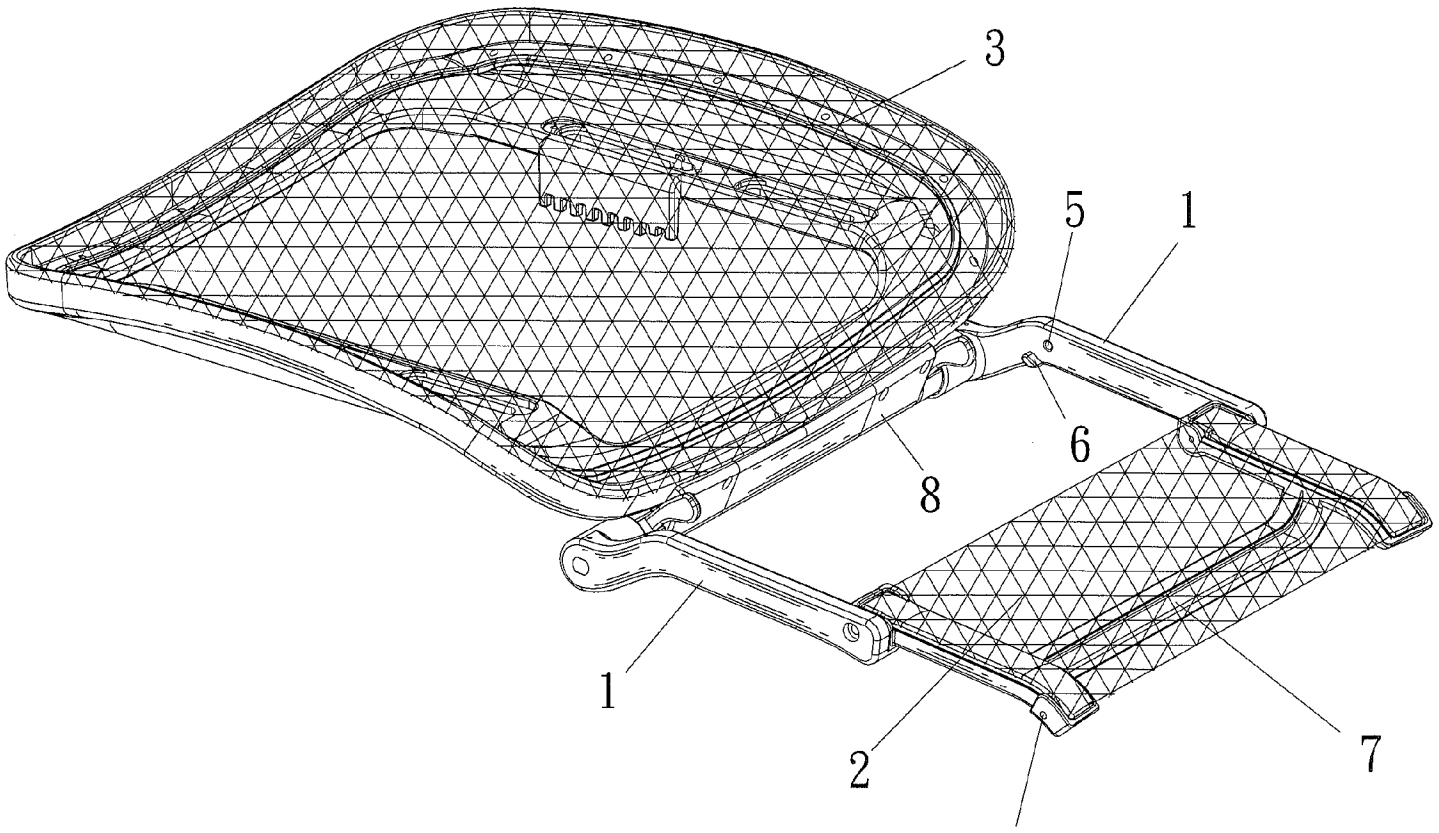
FIG. 1A is a perspective view showing the operation of a foldable leg support according to a first embodiment of the present invention.
Figure 1B:
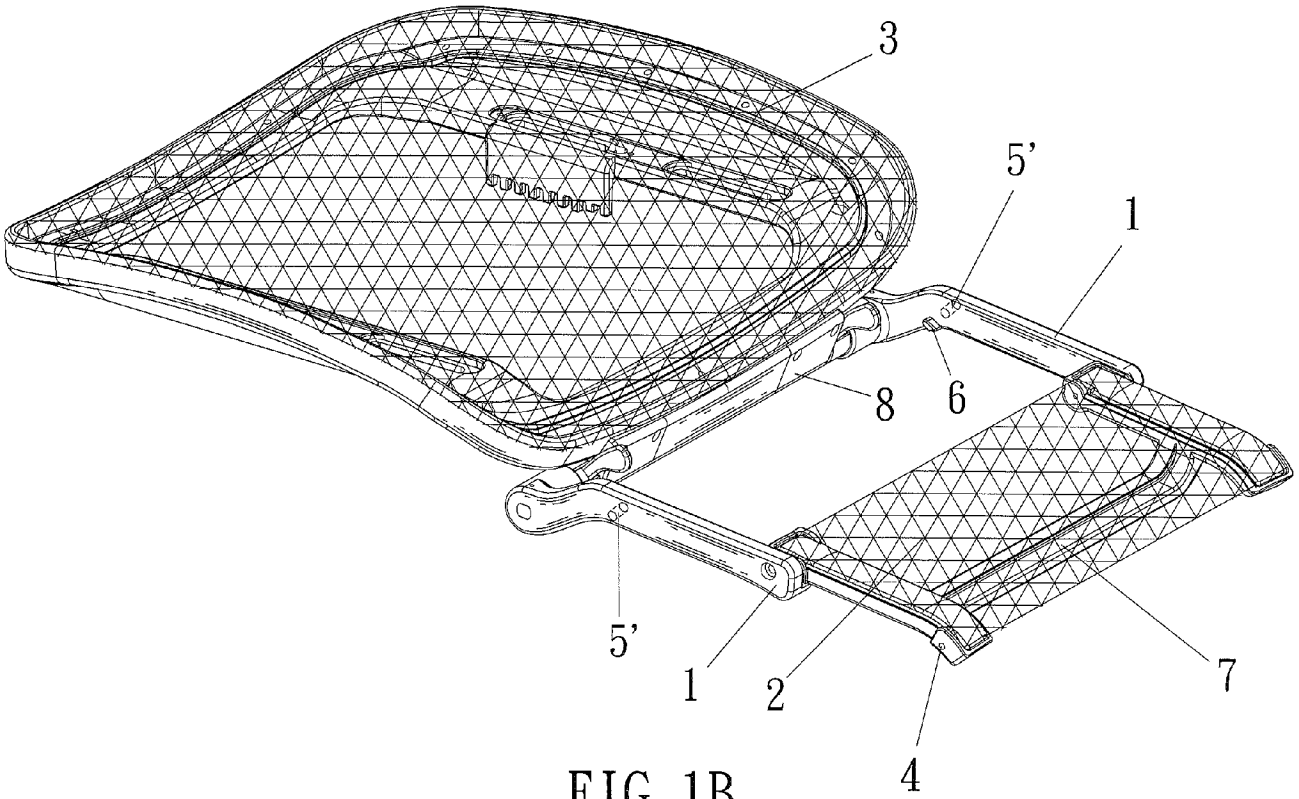
FIG. 1B is another perspective view showing the operation of the foldable leg support according to the first embodiment of the present invention.
Figure 2:
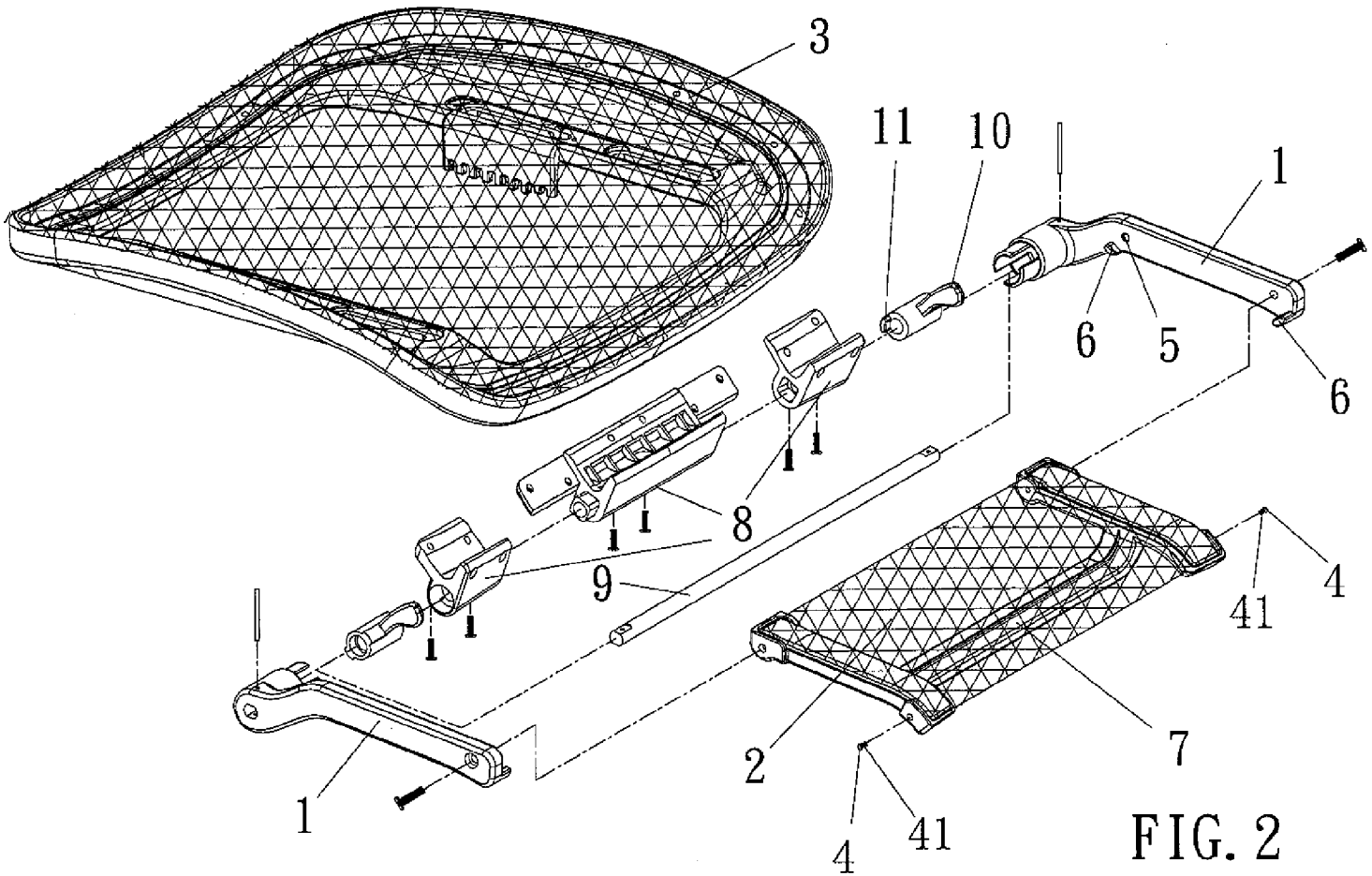
FIG. 2 is a perspective view showing the exploded components of the foldable leg support according to the first embodiment of the present invention; invention.

With reference to FIGS. 1A, 1B, and 2, a foldable leg support according to a first embodiment of the present invention comprises two rotary arms 1 and a supporting surface 2 between the two rotary arms 1. The two rotary arms I are rotatably connected with a seat member 3. Two first ends of the two rotary aims 1 are rotatably connected with two sides of the seat member 3 respectively, and two second ends of the rotary arms 1 are rotatably coupled with the supporting surface 2 individually.

The supporting surface 2 includes two semi-periphery projections 4 disposed on two peripheral sides thereof respectively. Each semi-periphery projection 4 is biased against by a spring 41, and each rotary arm 1 includes a notch 5 (or a hole 5') fixed on an inner side thereof to retain with the semi-periphery projection 4, obtaining a positioning function as the supporting surface 2 is stored.

Each rotary arm 1 also includes a limiting block 6 defined on an inner side of the first end thereof to support the supporting surface 2 when the foldable leg support is expanded and retracted.

To turn the supporting surface 2 easily, the supporting surface 2 includes a handle 7 arranged therebeneath.

The seat member 3 includes at least one positioning protrusion 8 formed therebeneath, and a shaft 9 is inserted through the positioning protrusions 8. The rotary arms 1 are fitted on the shaft 9 to connect with the positioning protrusions 8 rotatably.

Figure 3A:
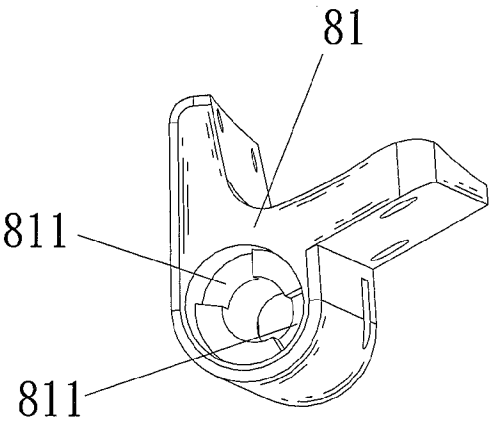
FIG. 3A is a perspective view showing the operation of a locking element of the foldable leg support according to the first embodiment of the present invention.
Figure 3B:
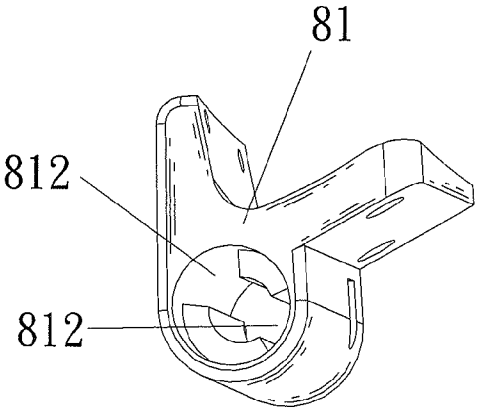
FIG. 3B is another perspective view showing the operation of the locking element of the foldable leg support according to the first embodiment of the present invention.
Figure 3C:
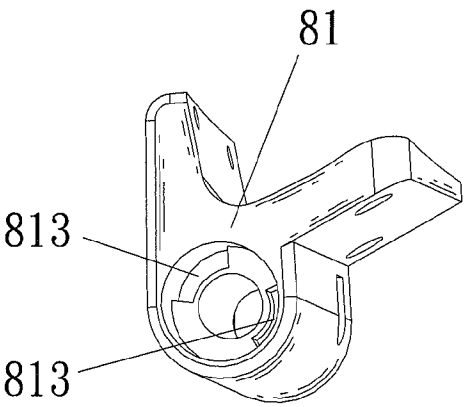
FIG. 3C is also another perspective view showing the operation of the locking element of the foldable leg support according to the first embodiment of the present invention.

Between the rotary arm 1 and the positioning protrusions 8 is defined a rotating bar 10, and each positioning protrusion 8 includes two locking elements 81 disposed therein. Each locking element 81 is retained with a boss 11 of the rotating bar 10 so that when the rotary arm 1 is expended and retracted, the boss 11 of the rotating bar 10 is inserted into two different locking elements 81, thereby positioning the rotary arm 1. When the rotating bar 10 is rotated outward, the boss 11 is disengaged from the locking element 81, thus rotating the rotary arm 1. As shown in FIGS. 3A-3C, the locking element 81 is selected from a cutout 811, a bore 812, and a recess 813.

The supporting surface 2 is a net-shaped curve surface and is made of a soft material to comfort a user's legs.

Figure 4:
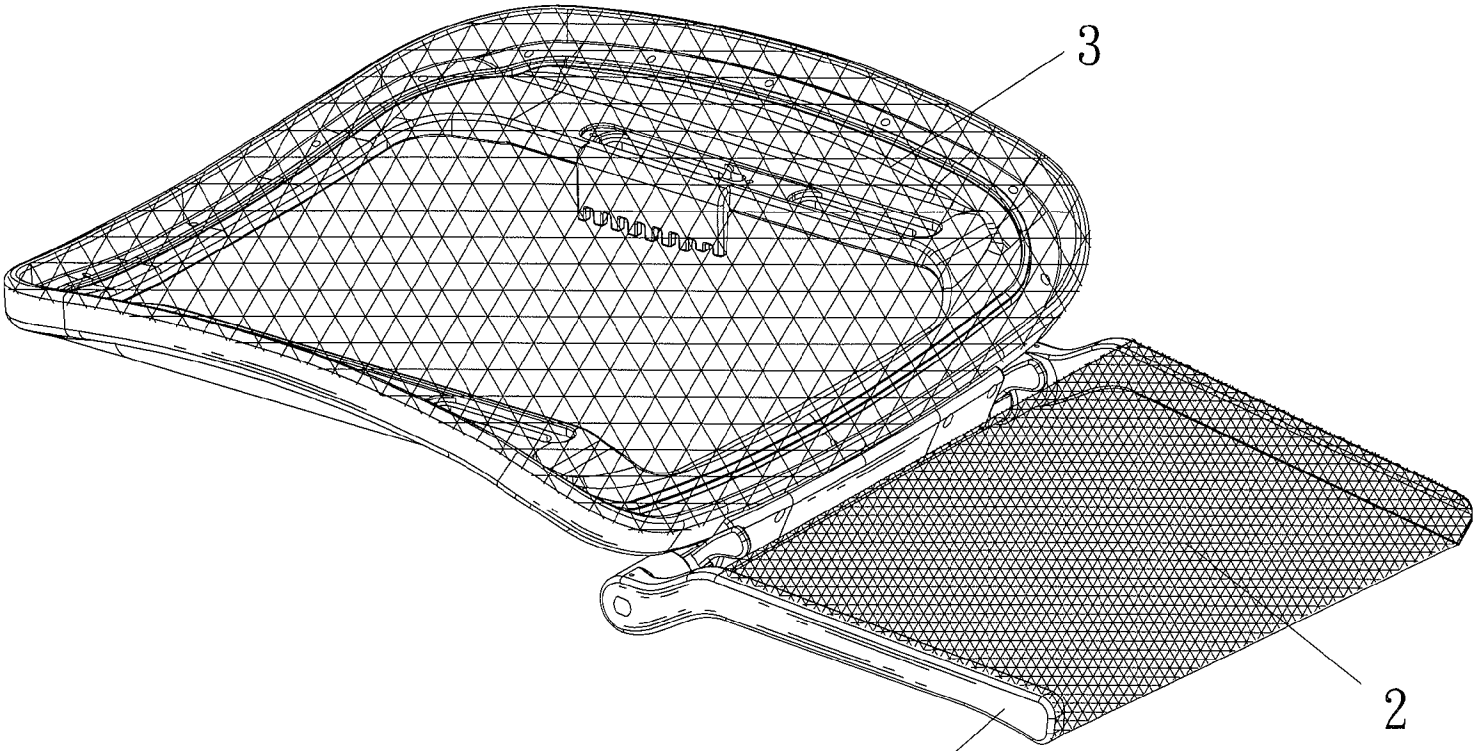
FIG. 4 is a perspective view showing the assembly of a foldable leg support according to a second embodiment of the present invention.

A difference of a foldable leg support of a second embodiment of the present invention from that of the first embodiment contains:

two first ends of two rotary arms 1 rotatably coupled with two sides of a seat member 3, and a supporting surface 2 fixed between the two rotary arms 1 as illustrated in FIG. 4.

Figure 5:
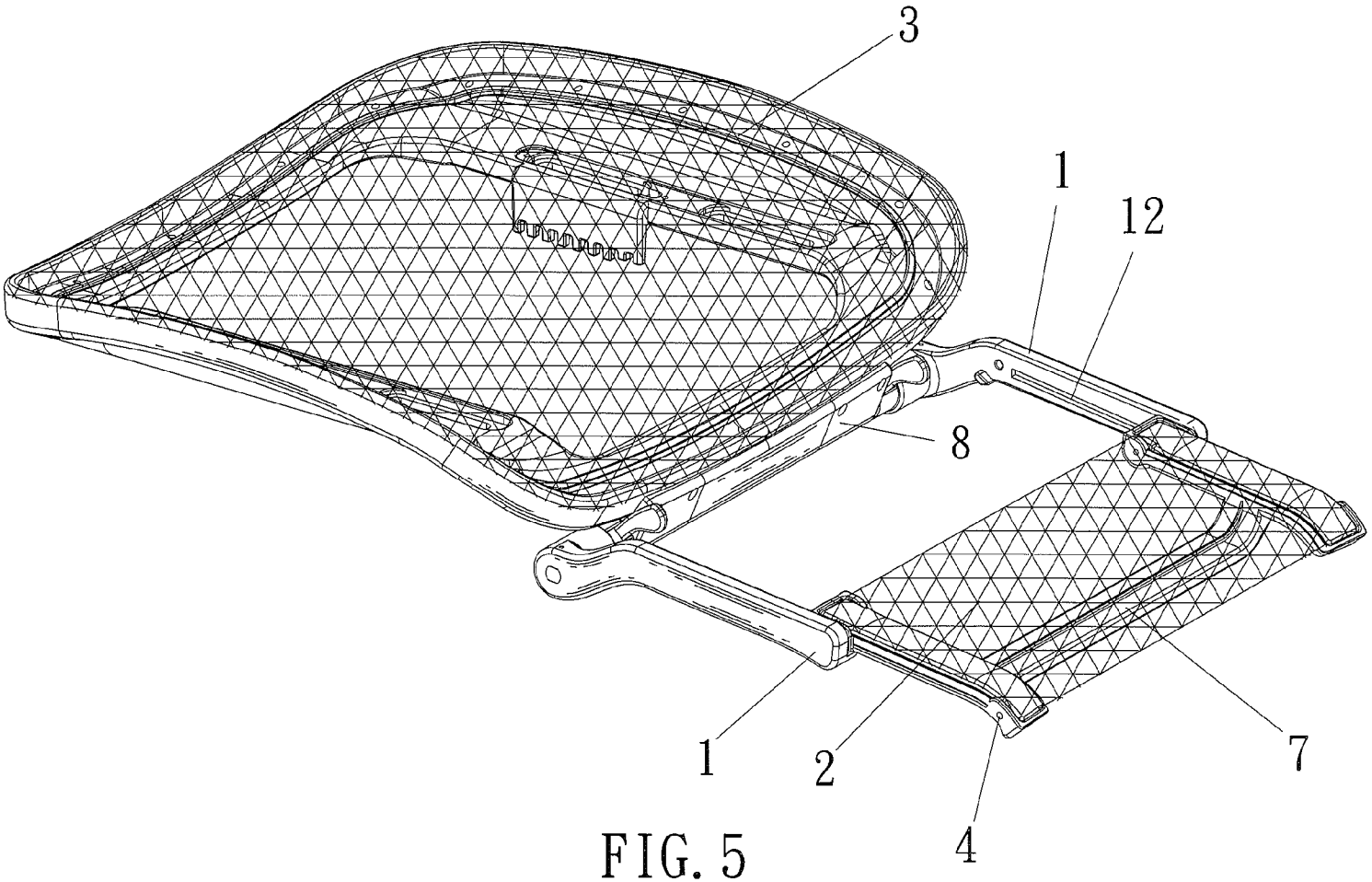
FIG. 5 is a perspective view showing the assembly of a foldable leg support according to a third embodiment of the present invention.

A difference of a foldable leg support of a third embodiment of the present invention from that of the first embodiment contains:

two first ends of two rotary arms 1 rotatably connected with two sides of a seat member 3, and a supporting surface 2 is slidably defined between the two rotary arms 1 by using two guide rails 12 formed on inner sides of the two rotary arms 1 individually as shown in FIG. 5.

While various embodiments in accordance with the present invention have been shown and described, it is clear to those skilled in the art that further embodiments may be made without departing from the scope of the present invention.

What is claimed is:

1. A foldable leg support comprising:

two rotary arms and a supporting surface between the two rotary arms, with the two rotary arms rotatably connected with a seat member, wherein the seat member includes two positioning protrusions formed therebeneath, wherein a shaft is inserted through the two positioning protrusions, wherein the two rotary arms are fitted on the shaft to connect with the two positioning protrusions rotatably, wherein between the two rotary arms and the two positioning protrusions is defined a rotating bar, and wherein each positioning protrusion includes two locking elements disposed therein, with a boss of the rotating bar being retained in one of the two locking elements.

2. The foldable leg support as claimed in claim 1, wherein two first ends of the two rotary arms are rotatably connected with two sides of the seat member respectively, and wherein two second ends of the two rotary arms are rotatably coupled with the supporting surface individually.

3. The foldable leg support as claimed in claim 2, wherein the supporting surface includes two semi-periphery projections disposed on two peripheral sides thereof respectively, wherein each semi-periphery projection is biased against by a spring, and wherein each rotary arm includes a notch fixed on an inner side thereof to retain with the semi-periphery projection when the supporting surface is in a stowed position relative to the two rotary arms.

4. The foldable leg support as claimed in claim 2, wherein the supporting surface includes two semi-periphery projections disposed on two peripheral sides thereof respectively, wherein each semi-periphery projection is biased against by a spring, and wherein each rotary arm includes a hole fixed on an inner side thereof to retain with the semi-periphery projection when the supporting surface is in a stowed position relative to the two rotary arms.

5. The foldable leg support as claimed in claim 3, wherein each rotary arm includes a limiting block defined on an inner side of the first end thereof.

6. The foldable leg support as claimed in claim 4, wherein each rotary arm includes a limiting block defined on an inner side of the first end thereof.

7. The foldable leg support as claimed in claim 1, wherein two first ends of the two rotary arms are rotatably coupled with two sides of the seat member, and wherein the supporting surface is fixed between the two rotary arms.

8. The foldable leg support as claimed in claim 1, wherein two first ends of two rotary arms are rotatably connected with two sides of the seat member, and wherein the supporting surface is slidably supported between the two rotary arms by using two guide rails formed on inner sides of the two rotary arms.

9. The foldable leg support as claimed in claim 1, wherein the locking element is selected from a cutout, a bore, and a recess.

10. The foldable leg support as claimed in claim 1, wherein the supporting surface is made of a soft fabric material and is formed as a curved surface or a flat surface.

11. The foldable leg support as claimed in claim 1, wherein the supporting surface is made of a soft net-shaped material and is formed as a curved surface or a flat surface.

12. The foldable leg support as claimed in claim 1, wherein the supporting surface is made from a feather material and is formed as a curved surface or a flat surface.

* * * * *